US006733595B1

(12) United States Patent
Grillo

(10) Patent No.: US 6,733,595 B1
(45) Date of Patent: May 11, 2004

(54) FOOTBRUSH DEVICE AND METHOD OF USING

(76) Inventor: Alphonse Grillo, 1256 Mullberry Dr., Mahwah, NJ (US) 07430

( * ) Notice: Subject to any disclaimer, the term of this patent is extended or adjusted under 35 U.S.C. 154(b) by 36 days.

(21) Appl. No.: 10/234,942

(22) Filed: Sep. 4, 2002

(51) Int. Cl.[7] ..... A47K 7/04

(52) U.S. Cl. ..... 134/6; 15/114; 15/161; 15/160; 15/244.1

(58) Field of Search ..... 15/114, 161, 112, 15/118, 160, 244.2, 244.1, 210.1; 134/6; D32/14.1

(56) References Cited

U.S. PATENT DOCUMENTS 1,327,943 A * 1/1920 Cohen ..... 15/112
4,532,668 A * 8/1985 Slonicki ..... 15/104.92
5,177,829 A * 1/1993 Simpson ..... 15/104.92
D355,734 S * 2/1995 Goble ..... D32/14.1
5,444,888 A * 8/1995 Withey ..... 15/114
5,560,068 A * 10/1996 Blake ..... 15/106

* cited by examiner

*Primary Examiner*—Gary K. Graham

(57) ABSTRACT

A new and improved footbrush device and method of using is disclosed for use in allowing a user to convenient means for cleaning the user's feet. The device comprises a wall hanger unit, an elongated handle, a bracket and a cleansing unit. The wall hanger unit is attachable to a wall. The elongated handle having a knob for slidably inserting and hanging in the open sleeve of the wall hanger unit. The bracket is attached to the distal end of the elongated handle. The cleansing unit is pivotally attached to the distal end of the bracket. The cleansing unit comprises a rigid base, a U-shaped cushion having two substantially parallel arms, and a brush sequestered between the two arms of the U-shaped cushion pad. The method of using the new and improved footbrush device comprises the steps of attaching, filing, hanging, lifting, obtaining, rotating, rubbing, scratching, sliding, turning, and twisting.

12 Claims, 4 Drawing Sheets

FOOTBRUSH DEVICE AND METHOD OF USING

FIELD OF THE INVENTION

The present invention relates to personal hygiene device, and mor particularly pertains to a footbrush device for use in allowing a convenient means for cleaning a user's foot.

DESCRIPTION OF THE PRIOR ART

The use of personal hygiene device is well known in the prior art. More specifically, personal hygiene devices heretofore devised and utilized are known to consist basically of familiar, expected and obvious structural configurations, notwithstanding the myriad of designs encompassed by the crowded prior art that have been developed for the fulfillment of countless objectives and requirements.

A wide variety of footbrush devices is currently available on the commercial market and an even larger number of these types of devices are known in the art of footbrush devices, for example, the utility cleaner and brush disclosed by Szabo and Szabo in U.S. Pat. No. 2,879,532; the foot scrubber with soap dispenser for user who cannot reach his feet disclosed by Slonicki in U.S. Pat. No. 4,532,668; the foot cleaning apparatus disclosed by Withey in U.S. Pat. No. 5,444,888; the reversible scrub brush and scraper disclosed by Carton in U.S. Pat. No. 5,479,673; the foot care shower brush disclosed by Blake in U.S. Pat. No. 5,560,068; and the cleaner for shoes and boots disclosed by Goble in U.S. Pat. No. D 355,734.

While all of the above-described devices fulfill their respective, particular objectives and requirements, the aforementioned patents do not describe a footbrush device having a U-shaped cushion pad defining two substantially parallel arms with a brush sequestered between the two arms of the U-shaped cushion pad. These elements that would specifically match the user's particular individual needs of making it possible to abrasively scrub a section of the foot with the brush while maintaining a comfortable contact with the foot with the U-shaped cushion pad. The above-described patents make no provision for a footbrush device having a U-shaped cushion pad defining two substantially parallel arms with a brush sequestered between the two arms of the U-shaped cushion pad so that the footbrush device can be used toto abrasively scrub a section of the foot with the brush while maintaining a comfortable contact with the foot with the U-shaped cushion pad.

Therefore, a need exists for a new and improved footbrush device having a having a U-shaped cushion pad defining two substantially parallel arms with a brush sequestered between the two arms of the U-shaped cushion pad. In this respect, the footbrush device according to the present invention substantially departs from the conventional concepts and designs of the prior art, and in doing so provides an apparatus primarily developed for the purpose of providing a device for use in abrasively scrubbing a section of the foot with the brush while maintaining a comfortable contact with the foot with the U-shaped cushion pad.

SUMMARY OF THE INVENTION

The present device, according to the principles of the present invention, overcomes the shortcomings of the prior art by providing a new and improved footbrush device comprising a wall hanger unit, an elongated handle, a bracket and a cleansing unit. The wall hanger unit is attachable to a wall. The elongated handle having a knob for slidably inserting and hanging in the open sleeve of the wall hanger unit. The bracket is attached to the distal end of the elongated handle. The cleansing unit is pivotally attached to the distal end of the bracket. The cleansing unit comprises a rigid base, a U-shaped cushion having two substantially parallel arms, and a brush sequestered between the two arms of the U-shaped cushion pad.

In view of the foregoing disadvantages inherent in the known type footbrush devices now present in the prior art, the present invention provides an improved footbrush device, which will be described subsequently in great detail, is to provide a new and improved footbrush device which is not anticipated, rendered obvious, suggested, or even implied by the prior art, either alone or in any combination thereof.

To attain this, the present invention essentially comprises a wall hanger unit, an elongated handle, a bracket and a cleansing unit. The wall hanger unit is attachable to a wall. The elongated handle having a knob for slidably inserting and hanging in the open sleeve of the wall hanger unit. The bracket is attached to the distal end of the elongated handle. The cleansing unit is pivotally attached to the distal end of the bracket. The cleansing unit comprises a rigid base, a U-shaped cushion having two substantially parallel arms, and a brush sequestered between the two arms of the U-shaped cushion pad.

There has thus been outlined, rather broadly, the more important features of the invention in order that the detailed description thereof that follows may be better understood, and in order that the present contribution of the art may be better appreciated.

The invention may also include an optional plurality of ridges on the top surface of the cleansing unit in which the plurality of ridges define a filing pad. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved footbrush device that has all the advantages of the prior art footbrush device and none of the disadvantages.

It is another object of the present invention to provide a new and improved footbrush device that may be easily and efficiently manufactured and marketed.

An even further object of the present invention is to provide a new and improved footbrush device that has a low cost of manufacture with regard to both materials and labor, and which accordingly is then susceptible of low prices of sale to the consuming public, thereby making such multi-purpose storage unit and system economically available to the buying public.

Still another object of the present invention is to provide a new footbrush device that provides in the apparatuses and methods of the prior art some of the advantages thererof, while simultaneously overcoming some of the disadvantages normally associated therewith.

Even still another object of the present invention is to provide a footbrush device having a U-shaped cushion pad defining two substantially parallel arms with a brush sequestered between the two arms of the U-shaped cushion pad. These elements make it possible to abrasively scrub a section of the foot with the brush while maintaining a comfortable contact with the foot with the U-shaped cushion pad.

Lastly, it is an object of the present invention to provide a new and improved method of using the new and improved footbrush device comprises the steps of attaching, filing, hanging, lifting, obtaining, rotating, rubbing, scratching, sliding, turning, and twisting.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
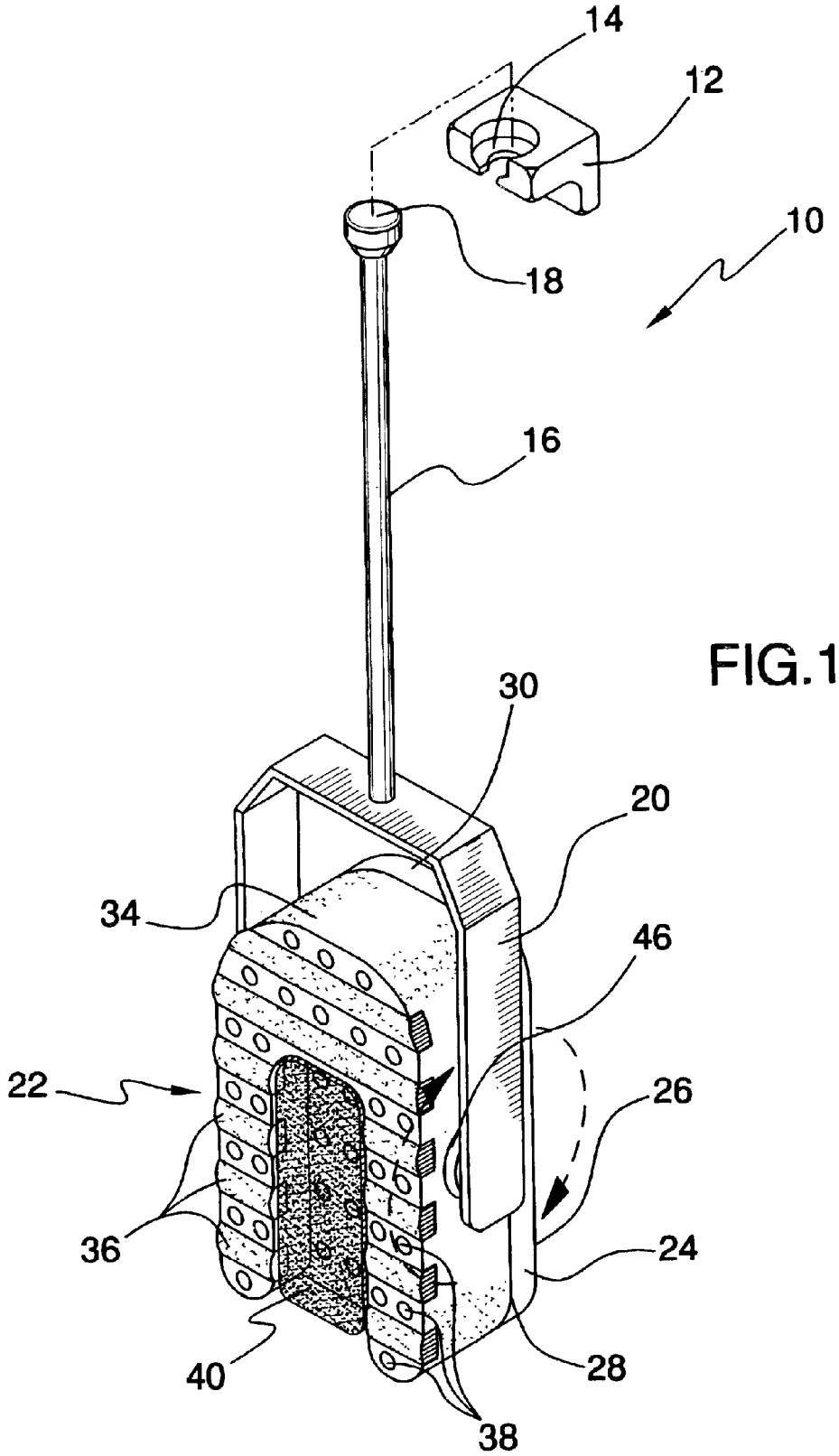
FIG. 1 is a perspective view of a preferred embodiment of the footbrush device constructed in accordance with the principles of the present invention.

Referring now to the drawings, and in particular FIG. 1 to 5 thereof, one preferred embodiment of the present invention is shown and generally designated by the reference numeral 10. One preferred embodiment of the footbrush device 10 for use in allowing a user a convenient means for cleaning the user's feet, the device 10 comprising: a wall hanger unit 12 having an open sleeve 14 defining an orifice, the wall hanger unit 12 is attachable to a wall; an elongated handle 16, the proximate end of the elongated handle 16 having a knob 18, the knob 18 of the elongated handle 16 is slidably insertable and hangable in the open sleeve 14 of the wall hanger unit 12; a bracket 20 having a proximate end and a distal end, the proximate end of the bracket 20 is attached to the distal end of the elongated handle 16; and a cleansing unit 22 pivotally attached to the distal end of the bracket 20, the cleansing unit 22 comprising: a rigid base 24 having a front surface 26, a back surface 28, a top surface 30 and two opposing sides 32; a U-shaped cushion pad 34 defining two substantially parallel arms, the U-shaped cushion pad 34 attached to the front surface 26 of the rigid base 24 of the cleanising unit 22, the U-shaped cushion pad 34 having a plurality of bristle packets 36 dispersed across the face of the U-shaped cushion pad 34 and having a plurality of drainage holes 38 traversing through the U-shaped cushion pad 34; and a brush 40 sequestered between the two arms of the U-shaped cushion pad 34 and attached to the front surface 26 of the rigid base 24 of the cleansing unit 22.

Another preferred embodiment of the footbrush device 10 comprises: a wall hanger unit 12 having an open sleeve 14 defining an orifice, the wall hanger unit 12 is attachable to a wall; an elongated handle 16, the proximate end of the elongated handle 16 having a knob 18, the knob 18 of the elongated handle 16 is slidably insertable and hangable in the open sleeve 14 of the wall hanger unit 12; a bracket 20 having a proximate end and a distal end, the proximate end of the bracket 20 is attached to the distal end of the elongated handle 16; and a cleansing unit 22 pivotally attached to the distal end of the bracket 20, the cleansing unit 22 comprising: a rigid base 24 having a front surface 26, a back surface 28, a top surface 30 and two opposing sides 32, the rigid base 24 including: a plurality of cylindrical protrusions 42 and a plurality of truncated conical protrusions 44 extending outwardly from the back surface 28 of the rigid base 24, the plurality of cylindrical protrusions 42 and the plurality of truncated conical protrusions 44 defining a scratching pad; and a plurality of ridges 52 on the top surface 30 of the rigid base 24, the plurality of ridges 52 defining a filing pad 50; a U-shaped cushion pad 34 defining two substantially parallel arms, the U-shaped cushion pad 34 attached to the front surface 26 of the rigid base 24 of the cleansing unit 22, the U-shaped cushion pad 34 having a plurality of bristle packets 36 dispersed across the face of the U-shaped cushion pad 34 and having a plurality of drainage holes 38 traversing through the U-shaped cushion pad 34; and a brush 40 sequestered between the two arms of the U-shaped cushion pad 34 and attached to the front surface 26 of the rigid base 24 of the cleansing unit 22.

One preferred embodiment of the method of using a footbrush device 10 for use in allowing a user a convenient means for cleaning the user's feet, the method comprising the steps of attaching, filing, hanging, lifting, obtaining, rotating, rubbing, scratching, sliding, turning, and twisting.

The obtaining step comprises obtaining the device 10 comprising: a wall hanger unit 12 having an open sleeve 14 defining an orifice, the wall hanger unit 12 is attachable to a wall; an elongated handle 16, the proximate end of the elongated handle 16 having a knob 18, the knob 18 of the elongated handle 16 is slidably insertable and hangable in the open sleeve 14 of the wall hanger unit 12; a bracket 20 having a proximate end and a distal end, the proximate end of the bracket 20 is attached to the distal end of the elongated handle 16; and a cleansing unit 22 pivotally attached to the distal end of the bracket 20, the cleansing unit 22 comprising: a rigid base 24 having a front surface 26, a back surface 28, a top surface 30 and two opposing sides 32, the rigid base 24 including: a plurality of cylindrical protrusions 42 and a plurality of truncated conical protrusions 44 extending outwardly from the back surface 28 of the rigid base 24, the plurality of cylindrical protrusions 42 and the plurality of truncated conical protrusions 44 defining a scratching pad; and a plurality of ridges 52 on the top surface 30 of the rigid base 24, the plurality of ridges 52 defining a filing pad 50; a U-shaped cushion pad 34 defining two substantially parallel arms, the U-shaped cushion pad 34 attached to the front surface 26 of the rigid base 24 of the cleansing unit 22, the U-shaped cushion pad 34 having a plurality of bristle packets 36 dispersed across the face of the U-shaped cushion pad 34 and having a plurality of drainage holes 38 traversing through the U-shaped cushion pad 34; and a brush 40 sequestered between the two arms of the U-shaped cushion pad 34 and attached to the front surface 26 of the rigid base 24 of the cleansing unit 22. The attaching step comprises attaching the wall hanger onto the wall. The sliding step comprises sliding the knob 18 of the elongated handle 16 into the open sleeve 14 of the wall hanger unit 12, the sliding step performed subsequent to the attaching step. The hanging step comprises hanging the knob 18 of the elongated handle 16 in the open sleeve 14 of the wall hanger unit 12, the hanging step performed subsequent to the sliding step. The lifting step comprises lifting up on the elongated handle 16 when the knob 18 is hanging in the open sleeve 14 of the wall hanger unit 12 to remove the elongated handle 16 from the wall hanger unit 12, the lifting step performed subsequent to the hanging step. The rotating step comprises rotating the cleansing unit 22 to expose the back surface 28 of the rigid base 24. The scratching step comprises scratching one of the user's feet with the scratching pad, the scratching step performed subsequent to the rotating step. The turning step comprises turning pivotally the cleansing unit 22 to expose the top surface 30 of the rigid base 24. The filing step comprises filing down a callous on one of the user's feet with the filing pad 50, the filing step performed subsequent to the turning step. The twisting step comprises twisting pivotally the cleansing unit 22 to expose the U-shaped cushion pad 34 and the brush 40 attached to the front surface 26 of the rigid base 24. The rubbing step comprises rubbing the U-shaped cushion pad 34 and the brush 40 onto a portion of the user's foot, the rubbing performed subsequent to the twisting step.

The bracket 20 may be any commercially available bracket like device. One preferred configuration of the bracket 20 has a U-shaped configuration having a proximate end and two distal ends, the proximate end of the bracket 20 is attached to the distal end of the elongated handle 16. The bracket 20 may also have two snap-on pivot pins 46, each respective distal end of the bracket 20 having a separate corresponding snap-on pivot pin 46. The bracket 20 may alternately have two snap-on collars 48, each respective distal end of the bracket 20 having a separate corresponding snap-on collar 48.

The rigid base 24 of the cleansing unit 22 may have two snap-on collars 48, each snap-on collar 48 positioned on opposing side walls of the rigid base 24, the snap-on collars 48 of the rigid base 24 are pivotally attached to the snap-on pivot pins 46 of the bracket 20. Alternately, the rigid base 24 of the cleansing unit 22 may have two snap-on pivot pins 46, each snap-on pivot pin 46 positioned on opposing side walls of the rigid base 24, the snap-on pivot pins 46 of the rigid base 24 are pivotally attached to the snap-on collars 48 of the bracket 20.

An optional plurality of cylindrical protrusions 42 may be added to the device 10. The plurality of cylindrical protrusions 42 may extend outwardly from the back surface 28 of the rigid base 24.

An optional plurality of truncated conical protrusions 44 may be added to the device 10. The plurality of truncated conical protrusions 44 may extend outwardly from the back surface 28 of the rigid base 24.

An optional plurality of cylindrical protrusions 42 and an optional plurality of truncated conical protrusions 44 may be added to the device 10. The plurality of cylindrical protrusions 42 and an optional plurality of truncated conical protrusions 44 may extend outwardly from the back surface 28 of the rigid base 24 defining a scratching pad.

An optional plurality of ridges 52 may be added to the device 10. The plurality of ridges 52 may on the top surface 30 of the rigid base 24, the plurality of ridges 52 defining a filing pad 50.

Referring now to FIG. 1 which depicts a perspective view of a preferred embodiment of the footbrush device 10 comprising: a wall hanger unit 12 having an open sleeve 14 defining an orifice, the wall hanger unit 12 is attachable to a wall; an elongated handle 16, the proximate end of the elongated handle 16 having a knob 18, the knob 18 of the elongated handle 16 is slidably insertable and hangable in the open sleeve 14 of the wall hanger unit 12; a bracket 20 having a proximate end and a distal end, the proximate end of the bracket 20 is attached to the distal end of the elongated handle 16; and a cleansing unit 22 pivotally attached to the distal end of the bracket 20, the cleansing unit 22 comprising: a rigid base 24 having a front surface 26, a back surface 28, a top surface 30 and two opposing sides 32; a U-shaped cushion pad 34 defining two substantially parallel arms, the U-shaped cushion pad 34 attached to the front surface 26 of the rigid base 24 of the cleansing unit 22, the U-shaped cushion pad 34 having a plurality of bristle packets 36 dispersed across the face of the U-shaped cushion pad 34 and having a plurality of drainage holes 38 traversing through the U-shaped cushion pad 34; and a brush 40 sequestered between the two arms of the U-shaped cushion pad 34 and attached to the front surface 26 of the rigid base 24 of the cleansing unit 22.

Figure 2:
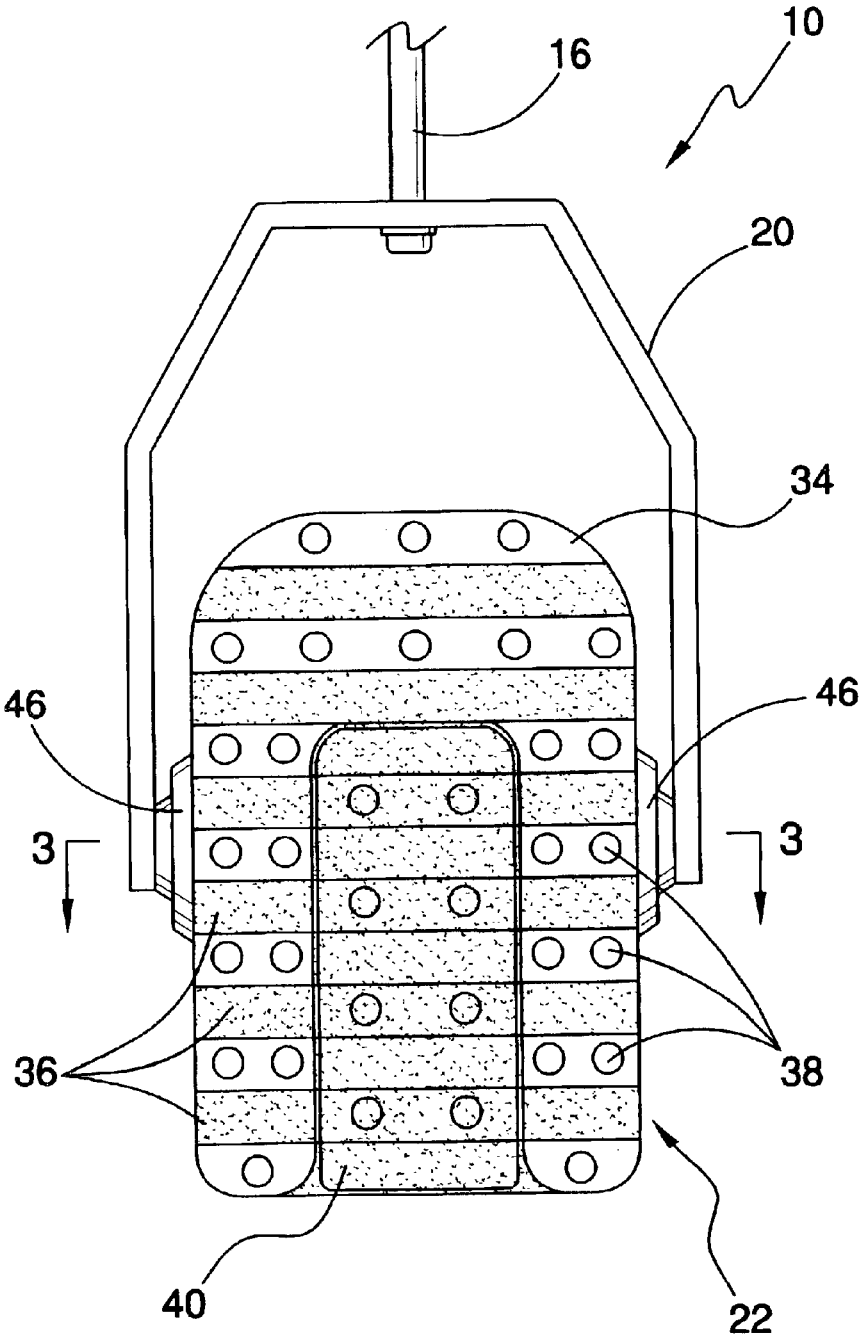
FIG. 2 is a frontal view of a preferred embodiment of the footbrush device of the present invention.

FIG. 2 is a frontal view of a cleansing unit attached to the bracket of preferred embodiment of the footbrush device 10 comprises: an elongated handle 16; a bracket 20 having a proximate end and a distal end, the proximate end of the bracket 20 is attached to the distal end of the elongated handle 16; and a cleansing unit 22 pivotally attached to the distal end of the bracket 20, the cleansing unit 22 comprising: a rigid base 24; a U-shaped cushion pad 34 attached to the front surface 26 of the rigid base 24 of the cleansing unit 22, the U-shaped cushion pad 34 having a plurality of bristle packets 36 dispersed across the face of the U-shaped cushion pad 34 and having a plurality of drainage holes 38 traversing through the U-shaped cushion pad 34; and a brush 40 sequestered between the two arms of the U-shaped cushion pad 34 and attached to the front surface 26 of the rigid base 24 of the cleansing unit 22.

Figure 3:
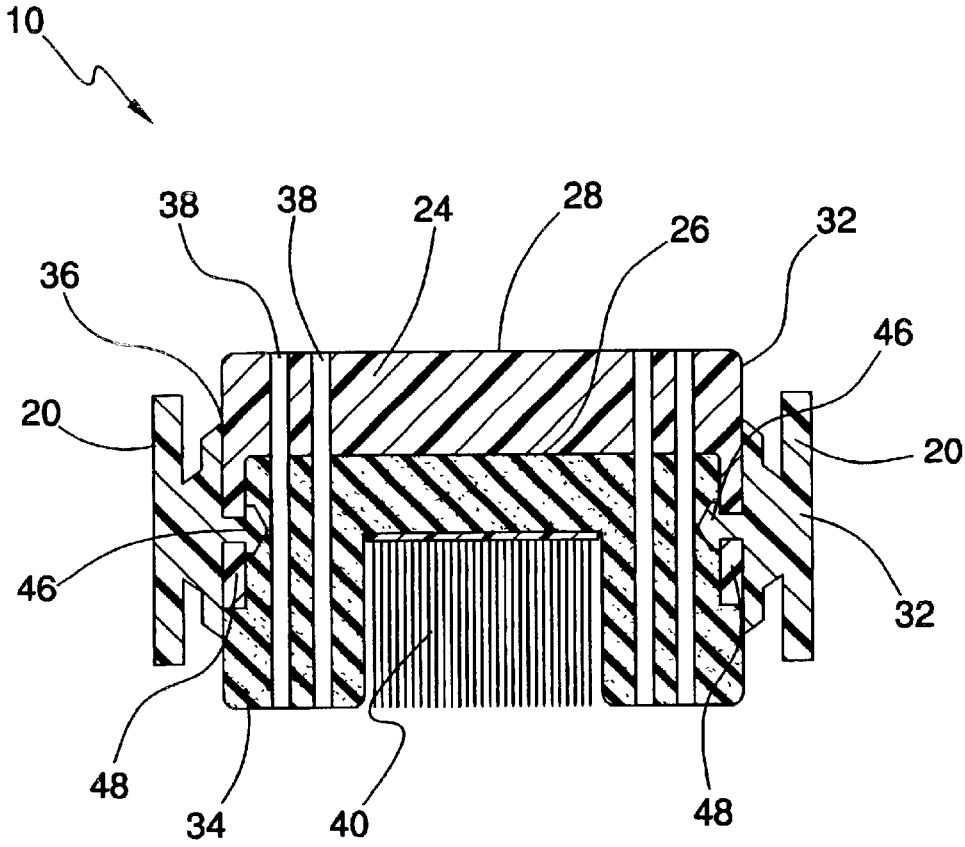
FIG. 3 is a cross sectional top view of a preferred embodiment of the footbrush device of the present invention.

FIG. 3 is a cross sectional top view of a preferred embodiment of the footbrush device 10 comprises: a bracket 20; and a cleansing unit 22 pivotally attached to the distal end of the bracket 20, the cleansing unit 22 comprising: a rigid base 24 having a front surface 26, a back surface 28, and two opposing sides 32; a U-shaped cushion pad 34 attached to the front surface 26 of the rigid base 24 of the cleansing unit 22 having a plurality of drainage holes 38 traversing through the U-shaped cushion pad 34; and a brush 40 sequestered between the two arms of the U-shaped cushion pad 34 and attached to the front surface 26 of the rigid base 24 of the cleansing unit 22.

Figure 4:
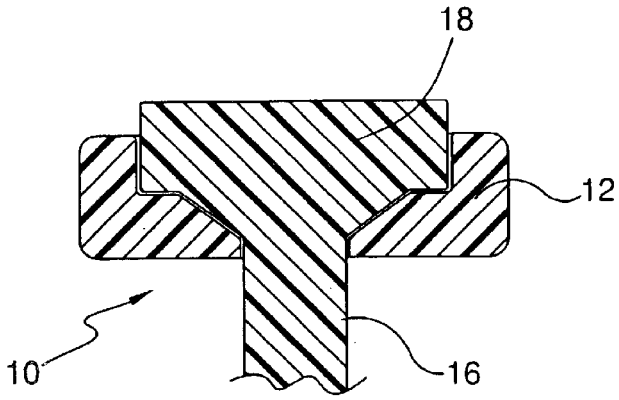
FIG. 4 is a cross sectional side view of a preferred embodiment of the footbrush device of the present invention.

Referring now to FIG. 4 which depicts a cross sectional side view of a preferred embodiment of the footbrush device 10 comprises a wall hanger unit 12 having an open sleeve 14 defining an orifice, the wall hanger unit 12 is attachable to a wall; an elongated handle 16, the proximate end of the elongated handle 16 having a knob 18, the knob 18 of the elongated handle 16 is slidably insertable and hangable in the open sleeve 14 of the wall hanger unit 12.

Figure 5:
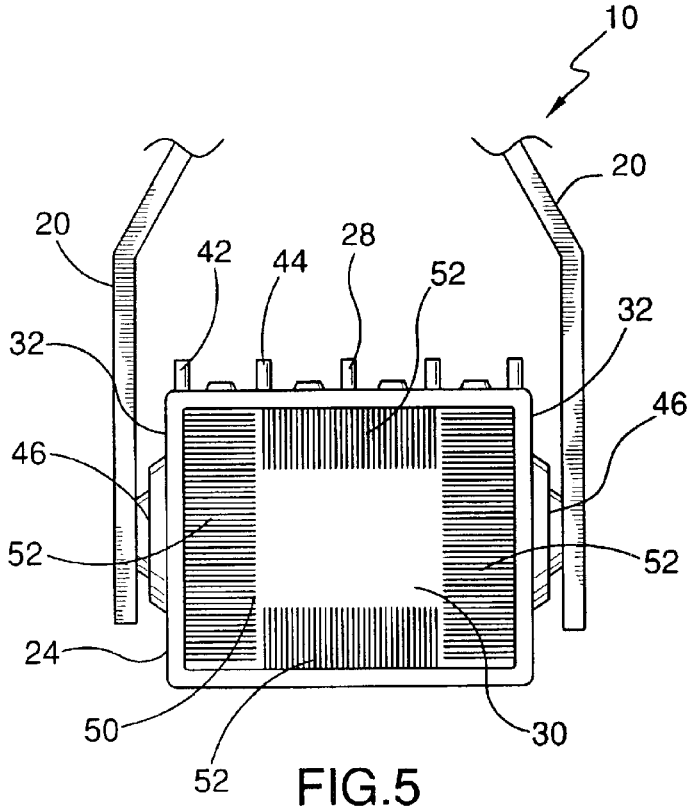
FIG. 5 is a top view of a top surface of a cleansing unit attached to the bracket of the preferred embodiment of the footbrush device of the present invention.

Referring now to FIG. 5 which depicts a top view of a top surface of a cleansing unit attached to the bracket of the preferred embodiment of the footbrush device comprises a bracket 20; and a cleansing unit 22 pivotally attached to the distal end of the bracket 20, the cleansing unit 22 comprising: a rigid base 24 having, a back surface 28, a top surface 30 and two opposing sides 32, the rigid base 24 including: a plurality of cylindrical protrusions 42 and a plurality of truncated conical protrusions 44 extending outwardly from the back surface 28 of the rigid base 24, the plurality of cylindrical protrusions 42 and the plurality of truncated conical protrusions 44 defining a scratching pad; and a plurality of ridges 52 on the top surface 30 of the rigid base 24, the plurality of ridges 52 defining a filing pad 50.

As to the manner of usage and operation of the present invention, the same should be apparent from the above description. Accordingly, no further discussion relating to the manner of usage and operation will be provided.

While a preferred embodiment of the footbrush device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A footbrush device for use in allowing a user a convenient means for cleaning the user's feet, said device comprising:

a wall hanger unit having an open sleeve defining an orifice, said wall hanger unit is attachable to a wall;

an elongated handle, the proximate end of said elongated handle having a knob, said knob of said elongated handle is slidably insertable and hangable in said open sleeve of said wall hanger unit;

a bracket having a proximate end and a distal end, the proximate end of said bracket is attached to the distal end of said elongated handle; and a cleansing unit pivotally attached to the distal end of said bracket, said cleansing unit comprising:

a rigid base having a front surface, a back surface, a top surface and two opposing sides;

a U-shaped cushion pad defining two substantially parallel arms, said U-shaped cushion pad attached to the front surface of said rigid base of said cleansing unit, said U-shaped cushion pad having a plurality of bristle packets dispersed across the face of said U-shaped cushion pad and having a plurality of drainage holes traversing through said U-shaped cushion pad; and a brush sequestered between the two arms of said U-shaped cushion pad and attached to the front surface of said rigid base of said cleansing unit.

2. The device described in claim 1 further comprising a plurality of cylindrical protrusions extending outwardly from the back surface of said rigid base.

3. The device described in claim 1 further comprising a plurality of truncated conical protrusions extending outwardly from the back surface of said rigid base.

4. The device described in claim 2 further comprising a plurality of truncated conical protrusions extending outwardly from the back surface of said rigid base.

5. The device described in claim 1 further comprising a plurality of ridges on the top surface of said rigid base, said plurality of ridges defining a filing pad.

6. The device described in claim 1 wherein said bracket having a U-shaped configuration having a proximate end and two distal ends, the proximate end of said bracket is attached to the distal end of said elongated handle.

7. The device described in claim 6 wherein said bracket having two snap-on pivot pins, each respective distal end of said bracket having a separate corresponding snap-on pivot pin.

8. The device described in claim 7 wherein said rigid base of said cleansing unit having two snap-on collars, each snap-on collar positioned on opposing side walls of said rigid base, said snap-on collars of said rigid base are pivotally attached to said snap-on pivot pins of said bracket.

9. The device described in claim 6 wherein said bracket having two snap-on collars, each respective distal end of said bracket having a separate corresponding snap-on collars.

10. The device described in claim 9 wherein said rigid base of said cleansing unit having two snap-on pivot pins, each snap-on pivot pin positioned on opposing side walls of said rigid base, said snap-on pivot pins of said rigid base are pivotally attached to said snap-on collars of said bracket.

11. A footbrush device for use in allowing a user a convenient means for cleaning the user's feet, said device comprising:

a wall hanger unit having an open sleeve defining an orifice, said wall hanger unit is attachable to a wall;

an elongated handle, the proximate end of said elongated handle having a knob, said knob of said elongated handle is slidably insertable and hangable in said open sleeve of said wall hanger unit;

a bracket having a proximate end and a distal end, the proximate end of said bracket is attached to the distal end of said elongated handle; and a cleansing unit pivotally attached to the distal end of said bracket, said cleansing unit comprising:

a rigid base having a front surface, a back surface, a top surface and two opposing sides, said rigid base including:

a plurality of cylindrical protrusions and a plurality of truncated conical protrusions extending outwardly from the back surface of said rigid base, said plurality of cylindrical protrusions and said plurality of truncated conical protrusions defining a scratching pad; and a plurality of ridges on the top surface of said rigid base, said plurality of ridges defining a filing pad;

a U-shaped cushion pad defining two substantially parallel arms, said U-shaped cushion pad attached to the front surface of said rigid base of said cleansing unit, said U-shaped cushion pad having a plurality of bristle packets dispersed across the face of said U-shaped cushion pad and having a plurality of drainage holes traversing through said U-shaped cushion pad; and a brush sequestered between the two arms of said U-shaped cushion pad and attached to the front surface of said rigid base of said cleansing unit.

12. A method of using a footbrush device for use in allowing a user a convenient means for cleaning the user's feet, said method comprising the steps of: obtaining the device comprising:

a wall hanger unit having an open sleeve defining an orifice, the wall hanger unit is attachable to a wall;

an elongated handle, the proximate end of the elongated handle having a knob, the knob of the elongated handle is slidably insertable and hangable in the open sleeve of the wall hanger unit;

a bracket having a proximate end and a distal end, the proximate end of the bracket is attached to the distal end of the elongated handle; and a cleansing unit pivotally attached to the distal end of the bracket, the cleansing unit comprising:

a rigid base having a front surface, a back surface, a top surface and two opposing sides, the rigid base including:

a plurality of cylindrical protrusions and a plurality of truncated conical protrusions extending outwardly from the back surface of the rigid base, the plurality of cylindrical protrusions and the plurality of truncated conical protrusions defining a scratching pad; and a plurality of ridges on the top surface of the rigid base, the plurality of ridges defining a filing pad;

a U-shaped cushion pad defining two substantially parallel arms, the U-shaped cushion pad attached to the front surface of the rigid base of the cleansing unit, the U-shaped cushion pad having a plurality of bristle packets dispersed across the face of the U-shaped cushion pad and having a plurality of drainage holes traversing through the U-shaped cushion pad; and a brush sequestered between the two arms of the U-shaped cushion pad and attached to the front surface of the rigid base of the cleansing unit;

attaching the wall hanger onto the wall;

sliding the knob of the elongated handle into the open sleeve of the wall hanger unit, said sliding step performed subsequent to said attaching step;

hanging the knob of the elongated handle in the open sleeve of the wall hanger unit, said hanging step performed subsequent to said sliding step;

lifting up on the elongated handle when the knob is hanging in the open sleeve of the wall hanger unit to remove the elongated handle from the wall hanger unit, said lifting step performed subsequent to said hanging step; rotating the cleansing unit to expose the back surface of the rigid base;

scratching one of the user's feet with the scratching pad, said scratching step performed subsequent to said rotating step;

turning pivotally the cleansing unit to expose the top surface of the rigid base;

filing down a callous on one of the user's feet with the filing pad, said filing step performed subsequent to said turning step;

twisting pivotally the cleansing unit to expose the U-shaped cushion pad and the brush attached to the front surface of the rigid base; and rubbing the U-shaped cushion pad and the brush onto a portion of the user's foot, said rubbing performed subsequent to said twisting step.

* * * * *